US005988937A

United States Patent [19]

Komoriya et al.

[11] Patent Number: 5,988,937

[45] Date of Patent: Nov. 23, 1999

[54] CRAWLER TYPE SOIL IMPROVING MACHINE

[75] Inventors: Yoichi Komoriya, Tokyo; Yasuhiro Yoshida; Taneaki Fujino, both of Kawasaki, all of Japan

[73] Assignee: Komatsu Ltd., Tokyo, Japan

[21] Appl. No.: 09/101,644

[22] PCT Filed: Jan. 9, 1997

[86] PCT No.: PCT/JP97/00021

§ 371 Date: Jul. 13, 1998

§ 102(e) Date: Jul. 13, 1998

[87] PCT Pub. No.: WO97/25485

PCT Pub. Date: Jul. 17, 1997

[30] Foreign Application Priority Data

Jan. 12, 1996 [JP] Japan ..... 8/22053

[51] Int. Cl.[6] ..... E02F 7/00

[52] U.S. Cl. ..... 404/90; 241/101.74; 404/91; 404/92

[58] Field of Search ..... 404/75, 90, 91, 404/92, 76; 241/101.74, 101.8

[56] References Cited

U.S. PATENT DOCUMENTS 4,676,688 6/1987 Caradot ..... 404/91
5,580,004 12/1996 Tamura et al. ..... 241/36
5,741,085 4/1998 Wirtgen ..... 404/75

FOREIGN PATENT DOCUMENTS 54-58901 5/1979 Japan .
56-28948 3/1981 Japan .
59-229570 12/1984 Japan .
5-138058 6/1993 Japan .
7-127090 5/1995 Japan .
7-331696 12/1995 Japan .

*Primary Examiner*—James A. Lisehora
*Attorney, Agent, or Firm*—Sidley & Austin

[57] ABSTRACT

The present invention provides a crawler type soil improving machine for efficiently crushing and mixing soft soil and a soil improving agent in order to regenerate such soil, and features excellent mobility and operability. The soil improving machine comprises: a crusher (4), disposed substantially at the center of a vehicle body (3), for crushing and mixing soil and a soil improving agent; a first hopper (40), disposed at one part of the vehicle body (3), for receiving soil; a second hopper (20), positioned between the crusher (4) and the first hopper (40), for receiving soil improving agent; a crawling member (2), arranged under the second hopper (20) and the vehicle body (3); a drive unit (5), arranged at the other part of the vehicle body (3) and including an engine (6) and hydraulic units (9, 10); and a conveyor (50), positioned below the first and second hoppers (40 and 20).

20 Claims, 8 Drawing Sheets

CRAWLER TYPE SOIL IMPROVING MACHINE

FIELD OF THE INVENTION

The present invention relates to a crawler type soil improving machine for improving soft ground, at the time of land reclaiming works or general engineering works, and sticky soil dug during water supply works, drainage works, or gas pipe laying works, etc.

BACKGROUND OF THE INVENTION

At present, it is inevitable that civil engineering works, construction works, etc., are required to be performed on soft ground, such as reclaimed land, in order to promote efficient use of limited space. Such soft ground is usually dehydrated by scattering a hardening agent so that the soil is regenerated. Further, when water supply or drainage works or gas pipe laying works are carried out, the ditches for laying the pipes are usually refilled, using soil which has been dug by construction machines such as hydraulic shovels. However, watery clay or sticky soil, which has been dug and stirred up by the hydraulic shovels or the like, cannot hold itself. Therefore, soil which is not usable for filling the ditches has to be relocated using dump trucks.

However, there is a problem in that a lot of dust is generated when soft ground is dried by the hardening agent. Further, there is a problem in that when a construction site is narrow, construction machines, such as vehicles for scattering hardening agents and vibrating rollers for ramming the land, etc., cannot be simultaneously introduced there. Still further, construction cost is increased when a number of construction machines are used according to conventional methods.

Japanese Patent Laid-Open Publication 54-58901 has proposed a soil improving method to overcome these problems. According to the publication, a predetermined amount of sticky soil, which is not applicable to filling ditches, is sequentially supplied, contacted with a soil improving agent having wet-hard characteristics in a predetermined ratio, and then crushed and mixed. The publication also discloses a soil improving machine, which comprises a conveyor for relocating sticky soil which is not usable for filling ditches, a cut screw for slicing the unusable soil into layers having a predetermined thickness and for removing surplus soil at an appropriate position, a device for adding a predetermined amount of wet-hard type soil improving agent to a preset amount of soil carried by the conveyor, and a crusher for crushing and mixing the soil and the soil improving agent.

This crushing/mixing machine is a stationary type machine and cannot be easily moved between construction sites. Therefore, the machine has to be disassembled and re-assembled when it is relocated, which means increases in working time and cost.

SUMMARY OF THE INVENTION

The present invention has been conceived in order to overcome the foregoing problems of the related art, and is intended to provide a crawler type soil improving machine which can efficiently crush and mix watery clay or sticky soil and a soil improving agent, such as lime, and which has excellent mobility and operability even at a narrow construction site.

The crawling type soil improving machine comprises: a hopper section, disposed at an upper part of a vehicle body for receiving soil and soil improving agent; and a crusher, for crushing and mixing soil and soil improving agent. The hopper section includes a first hopper, which is for receiving soil, and which is arranged at one part of a vehicle body; and a second hopper, which is for receiving soil improving agent and which is disposed between the first hopper and the crusher. The first and second hoppers are independent from each other. The crusher is arranged substantially at the upper center of the vehicle body. The crawler type soil improving machine further includes a crawling member arranged under the vehicle body; a drive unit, which includes an engine as a driving source and hydraulic units and which is arranged at the other part of the vehicle body; and an intake conveyor which is for conveying soil and soil improving agent and which is positioned below the first and second hoppers.

The second hopper can include a soil improving agent supply for controlling an amount of soil improving agent to be supplied. This supply, which is arranged below an exit at the bottom of the second hopper, includes a chute positioned under the exit for supplying soil improving agent to the intake conveyor, and a rotor which can freely adjust a rotational speed thereof and which has a plurality of feeder blades. The soil improving machine can be structured such that as the feeder blades rotate, soil improving agent in the second hopper is moved and is made to fall via the exit.

Further, the soil improving machine can include a discharge conveyor which is positioned below the drive unit and the crusher in order to carry the crushed and mixed substances from the crusher to the outside of the machine. The first hopper can overhang the front, part of the crawling member.

The first hopper can be inclined forwardly and downwardly. When viewed from the front side, the first hopper can include a top opening having an obtuse included angle, a guide located at the lower part thereof, and having an acute included angle, and a sieve in the shape of a lattice or a mesh present at a border of the top opening and the guide.

The auxiliary soil discharging device, of a rotary roller type having a number of projections on the outer surface, can be provided near a discharging part under the first hopper and above the intake conveyor. Further, a soil supply amount regulator can be provided above the intake conveyor in order to control a height of the soil on the intake conveyor.

The crawler type soil improving machine of the foregoing configuration can efficiently crush and mix soil of soft ground, such as reclaimed land or the like, and soil improving agent, such as lime, thereby regenerating the soft soil. This leads to a reduction in the civil engineering or construction cost. In addition, the soil improving machine is provided with the crawling member, and features its excellent operability at a small or rough work site. The soil improving machine can be relocated using a trailer truck, without disassembling and re-assembling procedures.

Soil discharged via the exit of the first hopper has its surface covered by soil improving agent from the second hopper, and is carried by the intake conveyor to the crusher in this state. Thereafter, soil covered with soil improving agent is efficiently crushed and mixed by the crusher. The crushed and agitated substances are carried to outside (outside the soil improving machine), and can be efficiently loaded onto dump trucks or the like.

The foregoing arrangement of the crusher, the various devices, the first and second hoppers, and the conveyors can keep the soil improving machine in a balanced state, and enable the machine to be reliably moved. Further, the first hopper and the drive unit, including the engine, are separately arranged on opposite positions of the soil improving machine, so that the engine is spaced apart from the first hopper, and does not absorb dust therefrom. This is effective in improving the durability of the engine. The first hopper is inclined forwardly and downwardly, which enables an operator of a loading machine, such as a hydraulic shovel, to easily observe the top opening of the first hopper. Further, soil scattering from the first hopper is slow to reach the crawler.

The top opening of the first hopper has an obtuse included angle, and the first hopper includes a plate for preventing scattering of soil. This enables the hydraulic shovel operator to supply soil into the first hopper without any problem. Further, the guide of the first hopper is inclined at an acute angle in order to drop soil quickly onto the intake conveyor. The sieve provided at the border of the top opening and the guide is effective in separating large rocks, large stones, or the like and in preventing them from being carried to the intake conveyor. Therefore, the crusher does not crush and mix such large objects, and is protected against damage caused by them. The first hopper overhangs the front part of the crawler. When soil is supplied to the first hopper from a loading machine, the rear part of the soil improving machine is raised, so that the first hopper, etc., are protected against excessive loads.

The soil supply amount regulator enables a predetermined amount of soil to be reliably and smoothly carried onto the intake conveyor and supplied to the crusher, which improves the operation efficiency of the crusher. The soil improving agent supply mechanism at the second hopper can control the amount of soil improving agent on the basis of characteristics (e.g. moisture content, grain size, viscosity, etc.) of soil in the first hopper, or on the basis of the strength of the regenerated soil required at respective work sites. Therefore, the crusher can efficiently crush and mix soil and the agent as required.

BEST MODE FOR CARRYING OUT THE INVENTION

Figure 1:
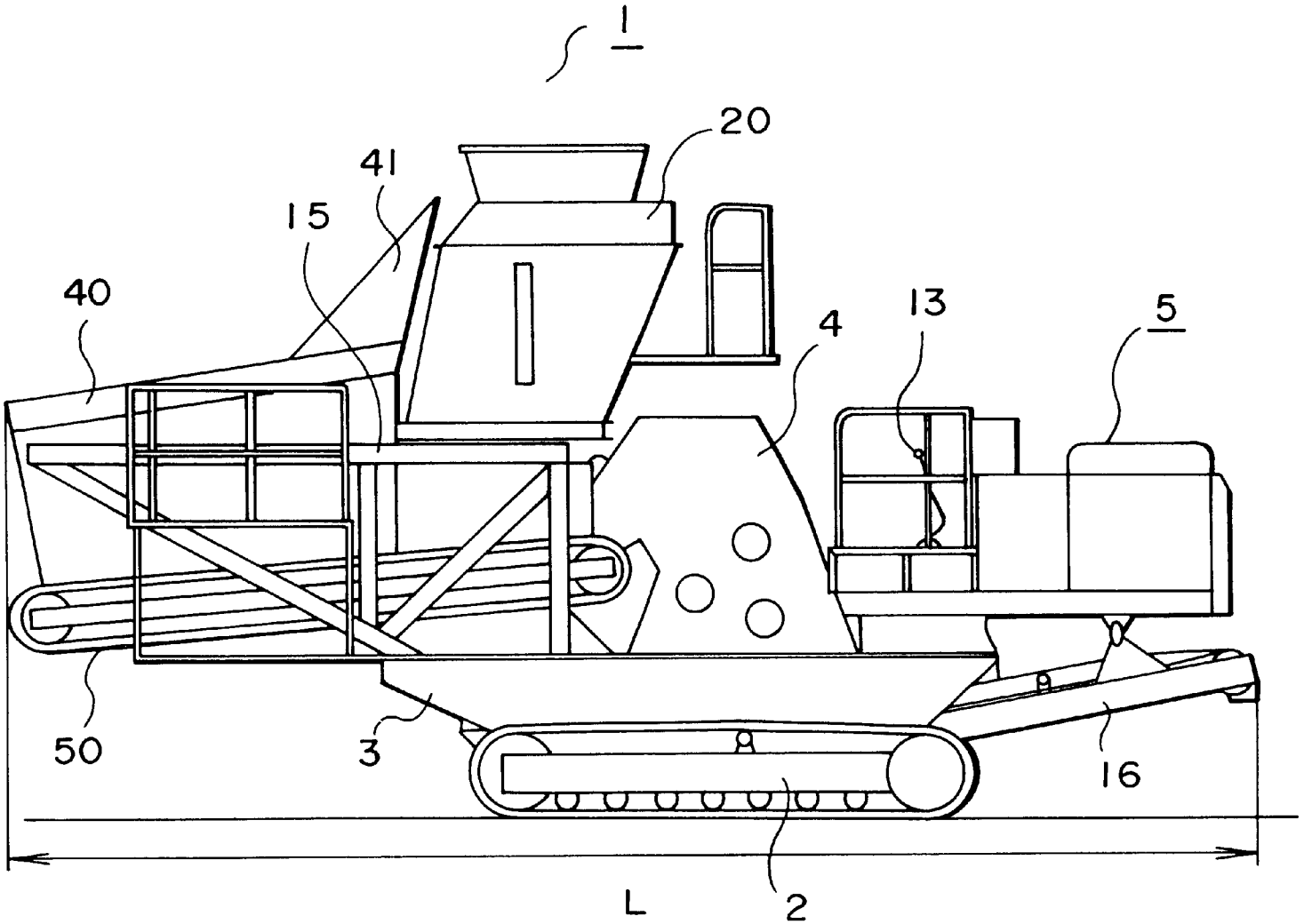
FIG. 1 is a side view of a crawler type soil improving machine according to the invention.

The invention will be described in detail with reference to a preferred embodiment shown in the drawings.

Referring to FIG. 1, a crawler type soil improving machine 1 comprises a crawling member 2, which is at the lower part of the machine and is driven by a motor (not shown); a vehicle body 3, arranged on the crawling member 2; a crusher 4, substantially at the center of the vehicle body 3; and a first hopper 40. The crawling member 2 can be a member having wheels. The first hopper 40 and a drive unit 5 are positioned at opposite parts of the vehicle body 3.

Figure 3:
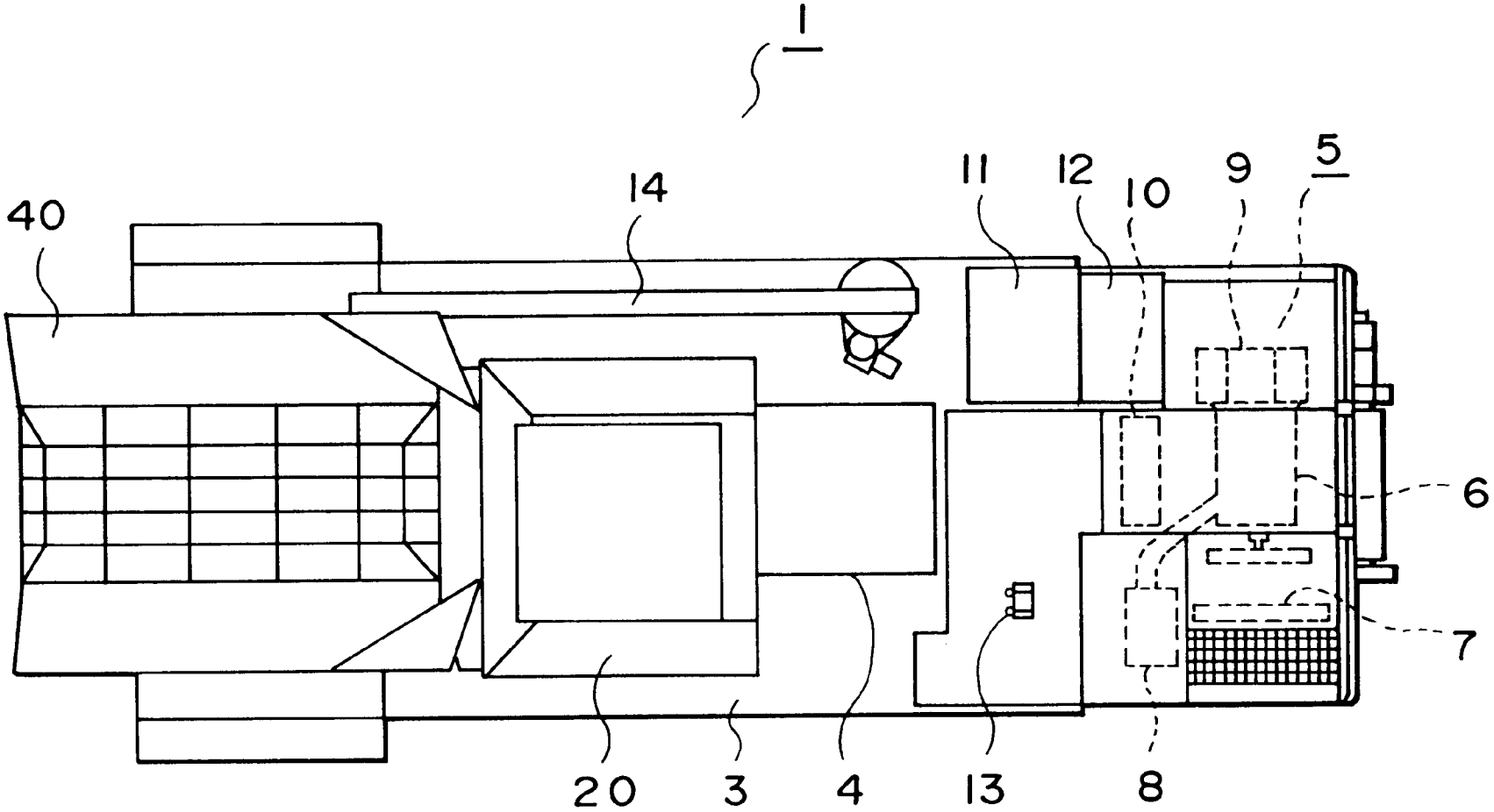
FIG. 3 is a plan view of the soil improving machine of FIG. 1.

An engine 6 is transversely arranged at the rear part of the vehicle body 3 as shown in FIG. 3. A radiator 7 and an air cleaner 8 are positioned in front of the engine 6, and on the left side of the vehicle body 3. A hydraulic pump 9 is positioned behind the engine 6, and is activated by the engine 6. A hydraulic lever 10 is present beside the engine 6.

The drive unit 5 is constituted by the engine 6, the radiator 7, the air cleaner 8, the hydraulic pump 9, and the hydraulic lever 10, and is positioned at the rear part of the vehicle body 3. The configuration and arrangement of the drive unit 5 are not limited to the foregoing ones. Alternatively, the drive unit 5 can include at least the hydraulic pump 9, the hydraulic lever 10, and the engine 6. Therefore, the drive unit 5 can be easily inspected and maintained. The drive unit 5 can also function as a counterweight, so that the vehicle body 3 can be balanced when the first hopper 40 at the front part of the vehicle body 3 receives soil. In this embodiment, the drive unit 5 is used as a drive source for the crawling member 2, the crusher 4, etc., of the soil improving machine 1. If necessary, a plurality of hydraulic pumps 9 and hydraulic levers 10 can be used.

A fuel tank 11 and a working oil tank 12 are arranged near the right center of the vehicle body 3. A hydraulic lever 13, for operating the crawling member 2 and other units and devices, is substantially at the left center of the vehicle body 3. A crane 14 is disposed in front of the working oil tank 12 on the right side of the vehicle body 3, and is used to supply soil improving agent such as lime, and to inspect the units and devices of the soil improving machine 1.

Figure 2:
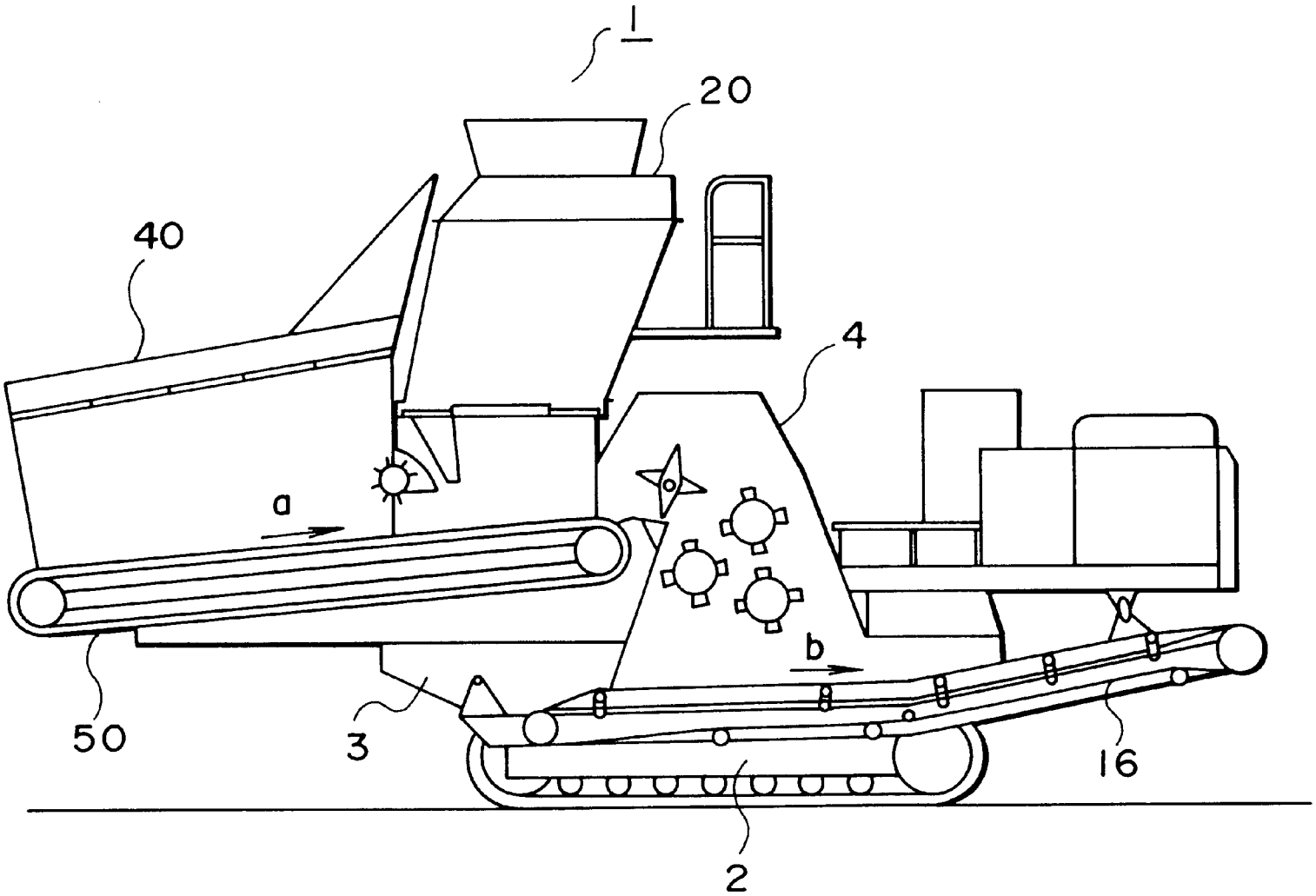
FIG. 2 is a schematic view of the soil improving machine of FIG. 1.

Referring to FIG. 1, a second hopper 20, for housing soil improving agent, is positioned in front of the crusher 4 and on a support frame 15 which is fixed to the vehicle body 3. A hydraulic conveyor 16 is positioned below the crusher 4. The conveyor 16 is operated in the direction shown by an arrow b (FIG. 2) in order to carry the regenerated soil toward the rear part of the vehicle body 3. The first hopper 40, for receiving soil, is disposed along the front edge of the support frame 15 and overhangs the crawling member 2. A hydraulic conveyor 50 is provided under the first and second hoppers 40 and 20, and is driven in the direction shown by an arrow a in FIG. 2, thereby supplying soil and soil improving agent to the crusher 4. The crawler type soil improving machine with the foregoing configuration has a whole length L, and can be loaded on a trailer truck.

Next, a description will be made of the second hopper 20 for housing soil improving agent, shown in FIG. 4. A body 21 of the second hopper 20 has a top lid 22 which can be freely opened and closed. A sharp cutter 23 is present at the upper part of the second hopper body 21. When a bag 51 filled with soil improving agent is suspended above the second hopper body 21 as shown by a dash-dot-dot-dash line, it is broken by the cutter 23, so that the soil improving agent will drop into the second hopper body 21. A window 24 is formed on a side surface of the second hopper body 21 in order to check the existing amount of the soil improving agent. The second hopper body 21 has a bottom plate 25 which is provided with a soil improving agent supply 30 structured as described hereinafter.

Figure 4:
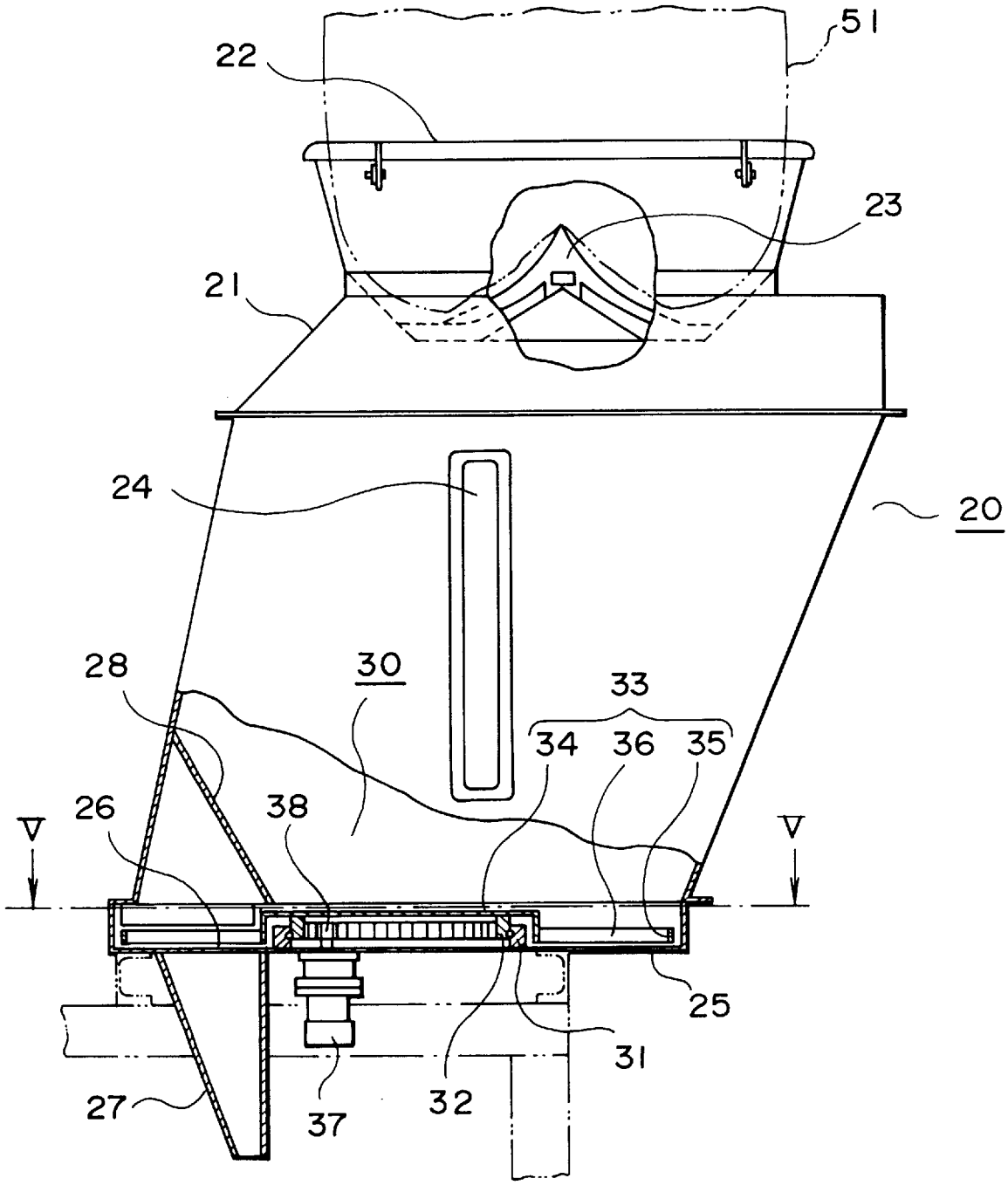
FIG. 4 is a cross section of the second hopper of the soil improving machine.
Figure 5:
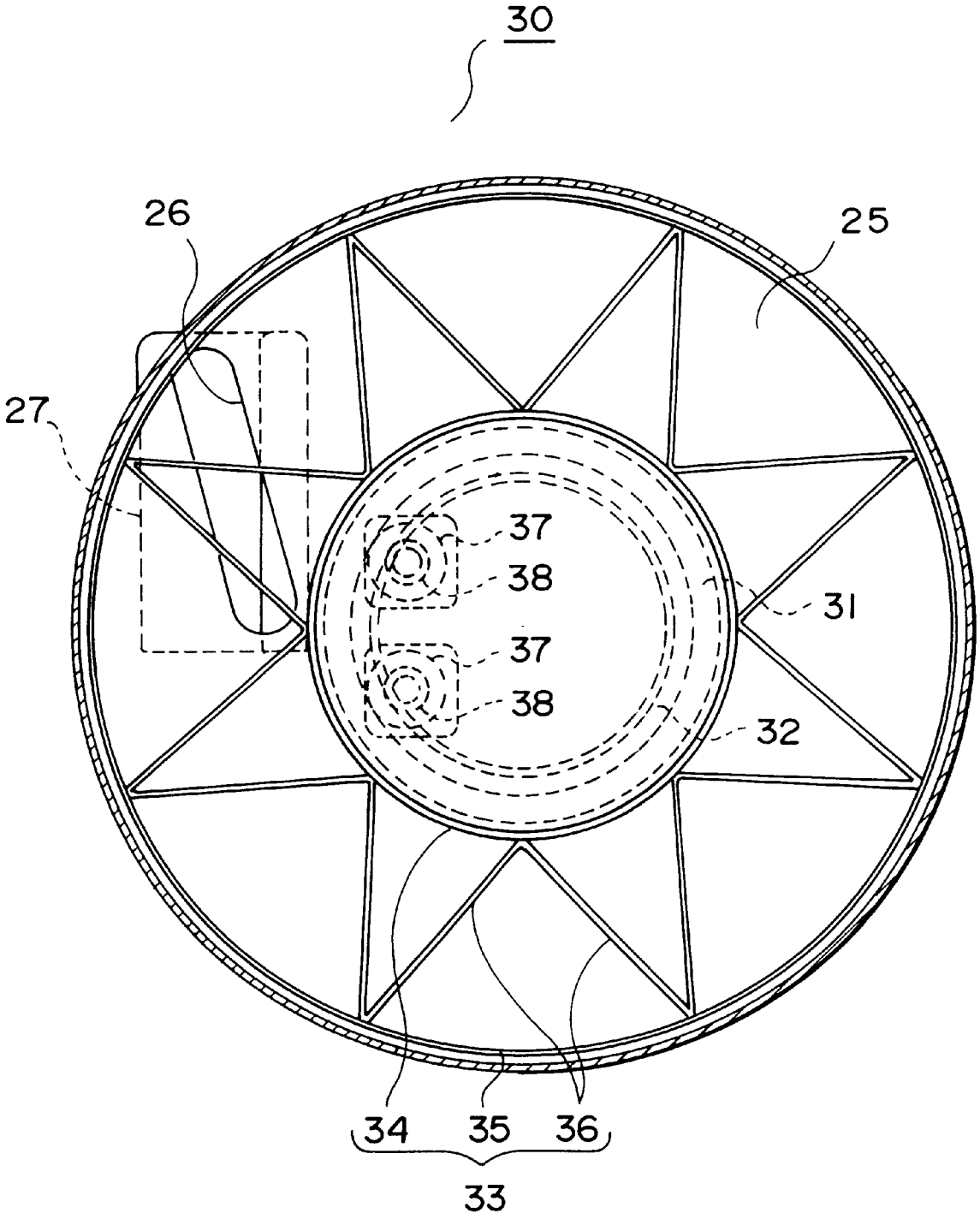
FIG. 5 is a cross section of the soil improving agent supply mechanism, taken along line V—V in FIG. 4.

Referring to FIG. 4, an outer race 31 of a rolling bearing is fixed to the bottom plate 25, and an inner race 32 of a rolling bearing having an inner gear is fixed to an inner ring 34 of a rotor 33. As shown in FIG. 5, two drive gears 38 are engaged with the inner gear of the inner race 32, so that a hydraulic motor 37 activates the rotor 33. A plurality of feeder blades 36 are disposed in the shape of a star wheel between the inner and outer rings 34 and 35 of the rotor 33. Referring to FIG. 5, an exit 26 is formed on the bottom plate 25, extending between the inner and outer rings 34 and 35. A chute 27 is positioned under the exit 26. A plate 28 is present above the rotor 33 on the bottom plate 25 of the second hopper body 21 and covers the exit 26, so that the amount of soil improving agent is regulated by controlling the position of the plate 28. The number of revolutions of the rotor 33 is adjusted on the basis of the number of revolutions of the hydraulic motor 37, and determines the amount of soil improving agent to be supplied.

Figure 6:
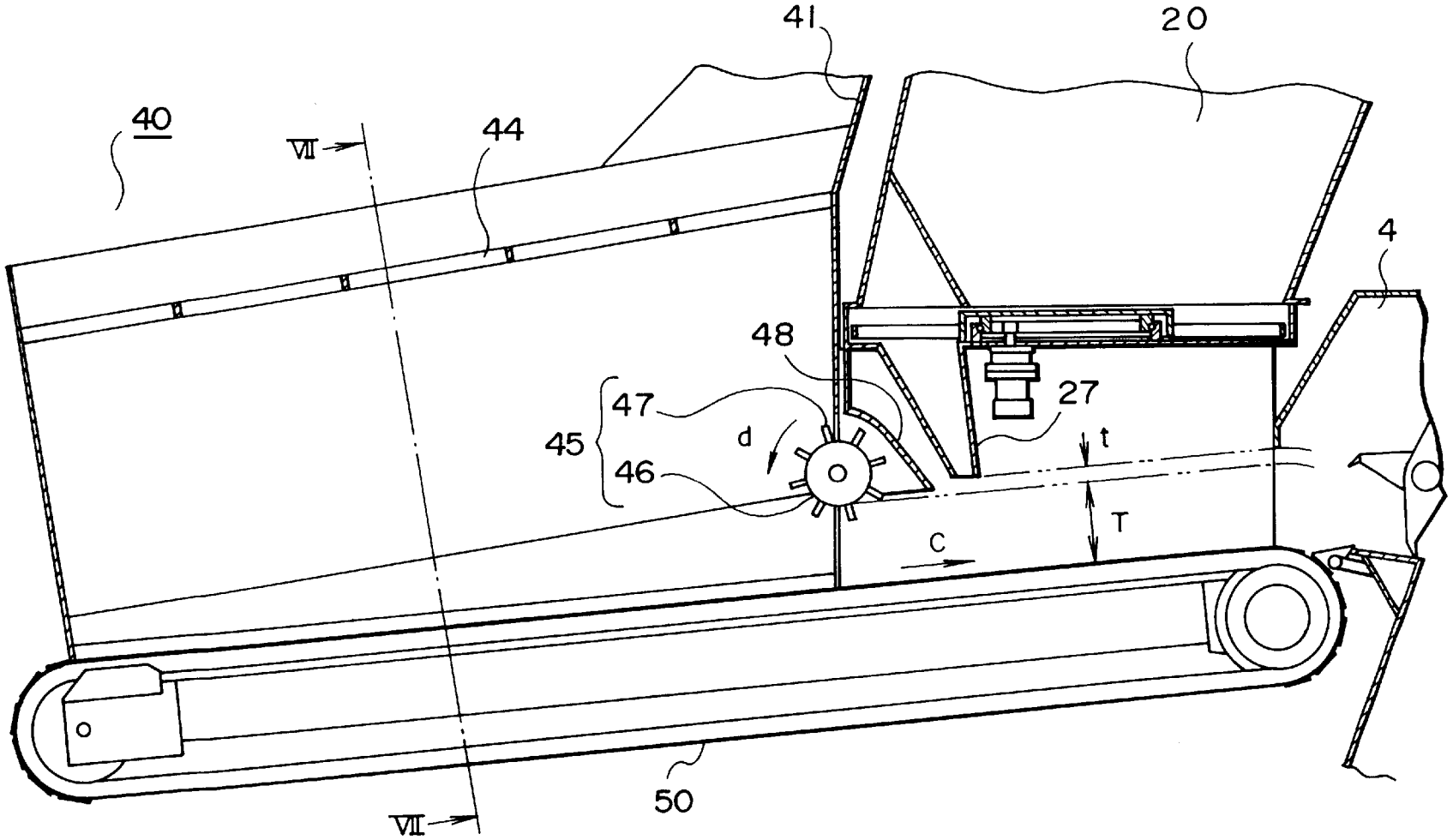
FIG. 6 is a cross section of the first and second hoppers, and the intake conveyor.
Figure 7:
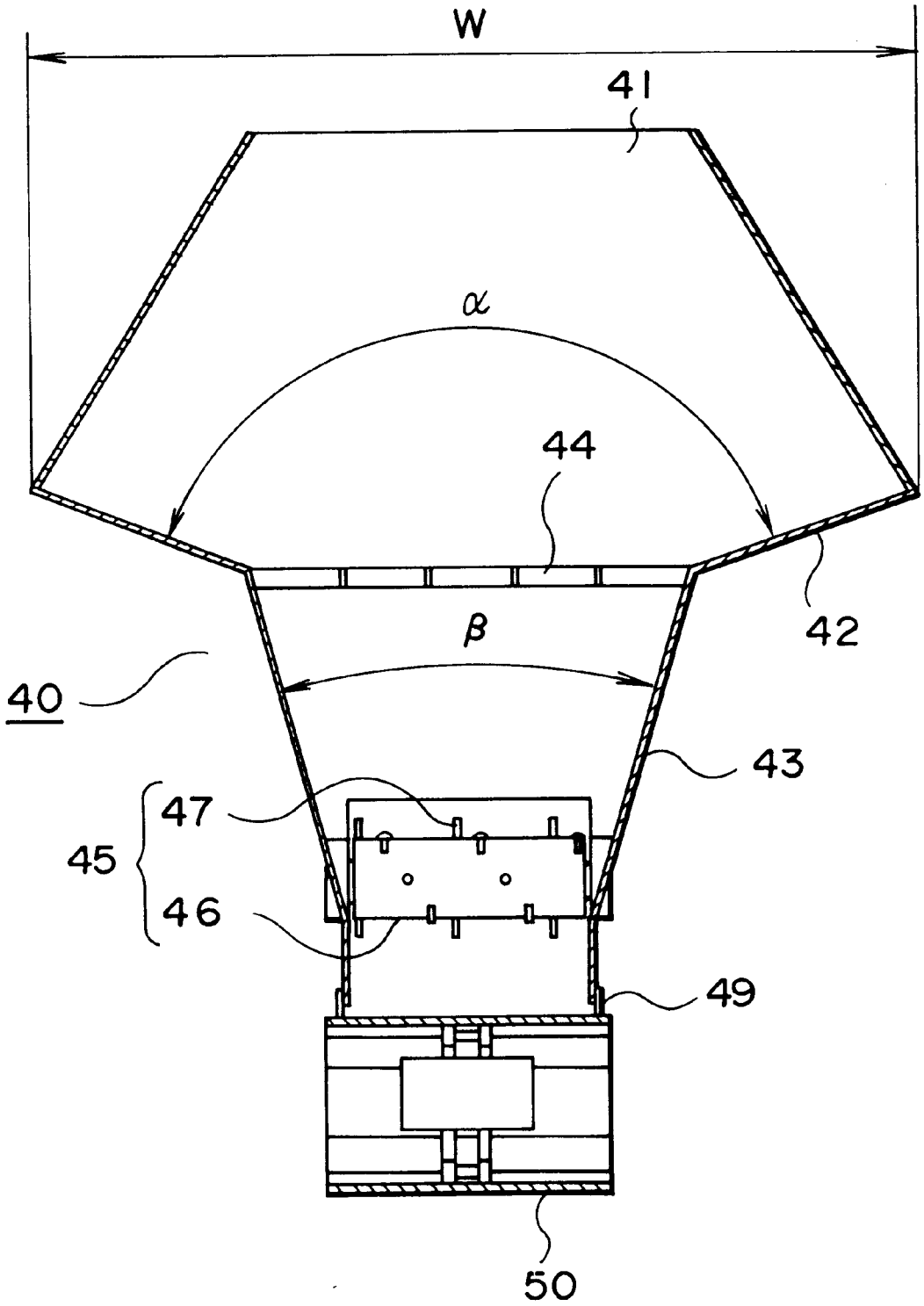
FIG. 7 is a cross section of the first hopper, taken along line VII—VII in FIG. 7.

The following describes the first hopper 40 and the intake conveyor 50. Referring to FIG. 6, the intake conveyor 50 extends under the first and second hoppers 40 and 20, reaches the crusher 4, and is made of iron. The first hopper 40 is inclined forwardly and downwardly, and has, across its rear edge, a plate 41 for preventing scattering of soil. As shown in FIG. 7, a top opening 42 has an obtuse included angle α (e.g. 140°) and a width W, which are large enough for soil to be loaded into the first hopper 40 using a hydraulic shovel or the like. An included angle β of the guide 43 at the lower part of the first hopper 40 is acute (e.g. 30°), which enables watery clay to slip easily downwardly. A sieve in the shape of a lattice or mesh is provided at the border of the top opening 42 and the guide 43, thereby preventing foreign materials, such as large stones, from being transmitted to the intake conveyor 50. A seal 49 extends from the lower end of the guide 43 to the upper surface of the conveyor 50 in order to prevent dust from being scattered.

Referring to FIG. 6, an auxiliary soil discharging unit 45 is disposed near a discharging part under the first hopper 40 and above the conveyor 50 by a distance T. The unit 45 includes a plurality of projections 47 on its peripheral surface, is hydraulically activated, and is rotated in the direction shown by an arrow d as the conveyor 50 moves in the direction shown by an arrow c. The unit 45 rotates to promote transmission of soil which may slip on the conveyor 50. The chute 27 of the second hopper 20 is inclined downwardly behind the device 45. The lower end of the chute 27 is present at a distance T+t from the surface of the conveyor 50. A device 48 for supplying a constant amount of soil is arranged between the unit 45 and the chute 27 in order to regulate at its bottom a height of soil carried on the conveyor 50.

The crawler type soil improving machine 1 operates in the following manner. Sticky soil of soft ground is loaded into the first hopper 40, while soil improving agent is put into the second hopper 20. The sticky soil is covered with soil improving agent, is carried on the conveyor 50, and is crushed and mixed by the crusher 4 at a discharging end of the conveyor 50. Uniformly mixed soil and soil improving agent are carried via the conveyor 16 outside of the soil improving machine 1. As described, the soil improving machine is effective in regenerating the dug sticky soil of the soft ground, and allowing construction machines (e.g. hydraulic shovels, etc.) to be utilized together with dump trucks at a construction site. Further, the soil improving machine is also applicable to improving watery clay and sticky soils which are dug for civil engineering works in order to lay water supply or sewer pipes, gas pipes, etc. The crawling member 2 features excellent mobility and operability on rough ground compared with a vehicle with wheels.

In the soil improving machine 1, the crusher 4 is positioned substantially at the center of the vehicle body 3. The drive unit 5, including the engine 6 and hydraulic units, is positioned at the rear part of the vehicle body 3, while the first and second hoppers 40 and 20 are present on the front part of the vehicle body 3. The conveyor 50 is located below the first and second hoppers 40 and 20. Therefore, the soil improving machine 1 is well balanced, and can move very smoothly. The operation lever 13, located substantially at the left center of the vehicle body 3, allows the operator to enjoy a wide field of view when moving and operating the soil improving machine.

The first hopper 40 being inclined forwardly and downwardly provides the operator of the hydraulic shovel with a wide field of view for the top opening 42. With the first hopper 40, the top opening 42 has the obtuse included angle α, the lower guide 43 has the acute included angle β, and the plate 41 is provided at the top opening 42 in order to prevent scattering of the soil. This enables the hydraulic shovel operator to discharge the soil without any difficulty, and the soil to be dropped easily. The first hopper 40 includes the sieve 44 arranged at the border of the top opening 42 and the guide 43, which prevents large rocks or stones from reaching the crusher 4 and protects the crusher 4 against damages caused by such objects.

The first hopper 40 overhangs the crawling member 2 (as shown in FIG. 1), thereby preventing an excessive load from being applied thereto and to other members of the soil improving machine when soil, etc., is forcibly loaded thereinto. The auxiliary soil discharging unit 45, located at the lower part of the first hopper 40, and the soil supply amount regulator 48, located above the conveyor 50, enable a constant amount of dug soil to be smoothly carried on the conveyor 50.

The crawler type soil improving machine 1 includes the first hopper 40 receiving dug soil, the second hopper 20 for housing soil improving agent, and the soil improving agent supply mechanism 30. This enables an appropriate amount of soil improving agent to be supplied via the chute 27 in accordance with the qualities (e.g. moisture content, granule sizes, stickiness, etc.) of the soil in the first hopper 40 and the rigidity of regenerated soil required at the work site.

In the soil improving machine, the necessary amount of soil to be carried is determined by the speed of the conveyor 50. The amount of soil improving agent is determined by controlling the number of revolutions of soil improving agent supply mechanism 30. As shown in FIG. 6, the amount of soil improving agent, i.e. a thickness (=distance t) of soil improving agent, is controlled in accordance with the thickness (=distance T). Therefore, it is possible to optionally set a ratio of soil and soil improving agent. This enables an appropriate amount of soil improving agent to be supplied via the chute 27 in accordance with the characteristics (e.g. moisture content, grain sizes, stickiness, etc.) of soil in the first hopper 40 and the rigidity of regenerated soil required at the work site.

In this embodiment, the crusher 4, the drive unit 5, the first and second hoppers 40 and 20, etc., are arranged on the vehicle body 3. Needless to say, the invention also covers the case where the crusher 4 is arranged on a moving body when the vehicle body 3 and the crawling member 2 are considered to constitute the moving body.

Figure 8:
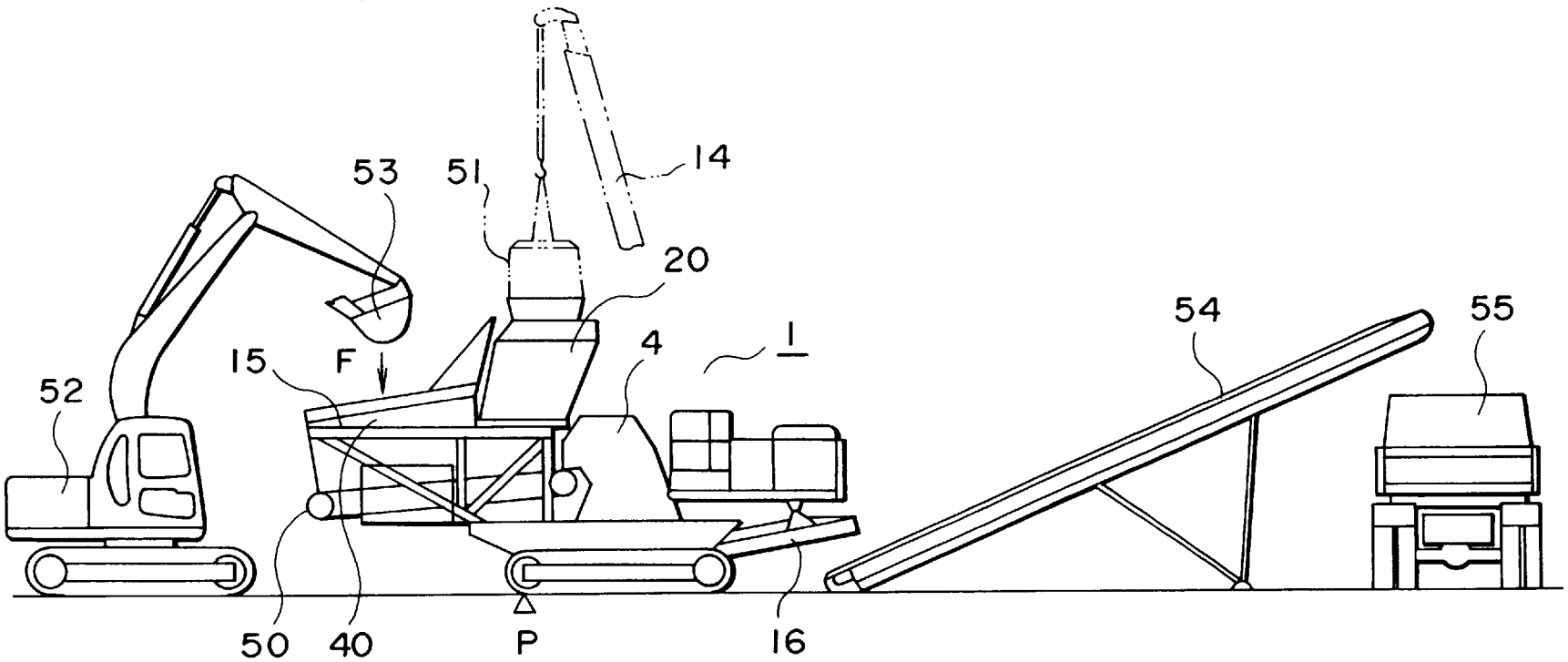
FIG. 8 is a schematic diagram which shows how soil improving work is carried out using the soil improving machine of the invention.

A soil improving operation will be described with reference to FIG. 8. A power shovel 52 with a bucket 53 is positioned in front of the first hopper 40 of the soil improving machine 1, and a portable conveyor 54 is positioned near the conveyor 16. A dump truck 55 is present at a discharging side of the conveyor 54. The soil improving machine 1 hooks up a bag 51 of soil improving agent, using the crane 14, and loads soil improving agent into the second hopper 20. The power shovel 52 puts soil, dug by the bucket 53, into the first hopper 40. The dug soil can be easily loaded into the first hopper 40 which has the large width W as described above.

The first hopper 40 can separate foreign materials such as large stones from the dug soil, using the sieve 44 (shown in FIG. 6). Sometimes, it is difficult to put watery clay or the like into the first hopper 40. In such a case, the watery clay or the like can be pushed downwardly by the back of the bucket 53, and a downward force F is applied to the first hopper 40. However, since the first hopper 40 overhangs the crawling member 2, the rear part of the soil improving machine 1 is lifted at a point P serving as a fulcrum, which is effective in regulating the downward force F, preventing the first hopper 40 and other units from being adversely affected by a large force. Therefore, there is no possibility that members such as the support frame 15, etc., are damaged. Soil in the first hopper 40 is covered by soil improving agent on the conveyor 50, crushed and mixed by the crusher 4, and regenerated as usable soil. The regenerated soil is carried by the conveyor 16, transferred to the portable conveyor 54, and loaded onto the dump truck 55. The soil improving operation is completed at this stage.

INDUSTRIAL APPLICABILITY

The soil improving machine according to the invention can efficiently crush and mix soft ground soil and soil improving agent in order to regenerate soil, and features excellent mobility and operability.

What is claimed is:

1. A crawler type soil improving machine comprising:

a vehicle body;

a crawling member arranged under said vehicle body;

a drive unit arranged on said vehicle body, said drive unit including an engine as a driving source;

a first hopper disposed at an upper part of the vehicle body for receiving soil, said first hopper overhanging a front end of said crawling member, said first hopper having a discharge opening;

a plate positioned along a rear edge of said first hopper, for preventing scattering of soil;

a crusher for crushing and mixing soil and soil improving agent;

a second hopper for receiving soil improving agent, said second hopper being disposed at an upper part of the vehicle body between said first hopper and said crusher, said second hopper being independent from said first hopper;

an intake conveyor, positioned below said first hopper and said second hopper, for conveying soil and soil improving agent to said crusher;

an auxiliary soil discharging unit disposed at said discharge opening of said first hopper and above said intake conveyer by a distance T;

a soil improving agent supply mechanism for regulating an amount of soil improving agent discharged from said second hopper onto soil on said intake conveyor; and a discharge conveyor, positioned below said drive unit and said crusher, for carrying crushed and mixed soil and soil improving agent from said crusher to outside said machine.

2. A crawler type soil improving machine in accordance with claim 1, wherein said auxiliary soil discharging unit comprises a rotatable roller having a plurality of projections extending from its peripheral surface, so that said roller can be rotated in a direction of transmission of soil on said intake conveyor to thereby promote transmission of soil which might slip on said intake conveyer.

3. A crawler type soil improving machine in accordance with claim 2, further comprising a chute extending downwardly from said second hopper to a distance (T+t) above said intake conveyor, and a soil supply amount regulator being positioned between said rotatable roller and said chute in order to regulate a height of soil on said intake conveyor.

4. A crawler type soil improving machine comprising:

a vehicle body;

a crawling member arranged under said vehicle body;

a drive unit arranged on said vehicle body, said drive unit including an engine as a driving source;

a first hopper disposed on said vehicle body for receiving soil, said first hopper having a discharge opening;

a crusher for crushing and mixing soil and soil improving agent;

a second hopper for receiving soil improving agent, said second hopper being disposed on said vehicle body between said first hopper and said crusher, said second hopper being independent from said first hopper, said second hopper having a bottom plate with an exit formed therein;

a cover plate positioned in said second hopper above said bottom plate to cover said exit;

an intake conveyor, positioned below said first hopper and said second hopper, for conveying soil and soil improving agent to said crusher; and a soil improving agent supply mechanism for regulating an amount of soil improving agent discharged from said second hopper onto soil on said intake conveyor, said soil improving agent supply mechanism comprising:

a rotor having a ring, and a plurality of feeder blades extending from said ring, said rotor being positioned in said second hopper so as to pass between said exit in said bottom plate and said cover plate; and a motor for rotating said rotor to control the passage of soil improving agent from said second hopper onto said intake conveyor.

5. A crawler type soil improving machine in accordance with claim 4, further comprising a chute positioned under said exit and above said intake conveyor in order to supply soil improving agent from said second hopper to said conveyer.

6. A crawler type soil improving machine in accordance with claim 4, wherein said rotor has an inner ring and an outer ring, and wherein said plurality of feeder blades extend between said outer ring and said inner ring.

7. A crawler type soil improving machine in accordance with claim 6, wherein said exit in said bottom plate extends generally between said inner and outer rings of said rotor.

8. A crawler type soil improving machine in accordance with claim 6, wherein said plurality of feeder blades extending between said inner and outer rings are disposed in a shape of a star wheel.

9. A crawler type soil improving machine in accordance with claim 8, wherein said exit in said bottom plate extends generally between said inner and outer rings of said rotor.

10. A crawler type soil improving machine in accordance with claim 9, further comprising a chute positioned under said exit and above said intake conveyor in order to supply soil improving agent from said second hopper to said conveyer.

11. A crawler type soil improving machine comprising:

a vehicle body;

a crawling member arranged under said vehicle body;

a drive unit arranged on said vehicle body, said drive unit including an engine as a driving source;

a first hopper disposed on said vehicle body for receiving soil, said first hopper having a discharge opening;

a crusher for crushing and mixing soil and soil improving agent;

a second hopper for receiving soil improving agent, said second hopper being disposed at an upper part of the vehicle body between said first hopper and said crusher, said second hopper being independent from said first hopper;

an intake conveyor, positioned below said first hopper and said second hopper, for conveying soil and soil improving agent to said crusher;

a rotary roller disposed at said discharge opening of said first hopper and above said intake conveyer by a distance T, said rotary roller having a plurality of projections on an outer peripheral surface thereof so that said roller can be rotated in a direction of transmission of soil on said intake conveyor in order to discharge soil from said first hopper onto said intake conveyer; and a soil supply amount regulator provided between said rotary roller and said crusher and above said intake conveyer in order to regulate a height of soil on said intake conveyer.

12. A crawler type soil improving machine in accordance with claim 11, further comprising a chute extending downwardly from said second hopper to a distance (T+t) above said intake conveyor, said soil supply amount regulator being positioned between said rotary roller and said chute.

13. A crawler type soil improving machine in accordance with claim 12, further comprising a soil improving agent supply mechanism for regulating an amount of soil improving agent discharged from said second hopper onto soil on said intake conveyor.

14. A crawler type soil improving machine in accordance with claim 13, wherein said second hopper has a bottom plate with an exit formed therein, and wherein said soil improving agent supply mechanism comprises a rotor having a ring and a plurality of feeder blades extending from said ring, said rotor being positioned in said second hopper so as to pass above said exit in said bottom plate of said second hopper.

15. A crawler type soil improving machine in accordance with claim 14, further comprising a cover plate positioned in said second hopper above said bottom plate to cover said exit, and wherein said rotor passes between said bottom plate and said cover plate.

16. A crawler type soil improving machine in accordance with claim 15, wherein said rotor has an inner ring and an outer ring, and wherein said plurality of feeder blades extend between said outer ring and said inner ring.

17. A crawler type soil improving machine in accordance with claim 16, wherein said exit in said bottom plate extends generally between said inner and outer rings of said rotor.

18. A crawler type soil improving machine in accordance with claim 16, wherein said plurality of feeder blades extending between said inner and outer rings are disposed in a shape of a star wheel.

19. A crawler type soil improving machine in accordance with claim 18, wherein said exit in said bottom plate extends generally between said inner and outer rings of said rotor.

20. A crawler type soil improving machine in accordance with claim 19, wherein said soil supply amount regulator is provided between said rotary roller and said chute.

* * * * *